US011015152B2

(12) United States Patent
Wang et al.

(10) Patent No.: US 11,015,152 B2
(45) Date of Patent: May 25, 2021

(54) CLEANSING BARS WITH TAURINE

(71) Applicant: Colgate-Palmolive Company, New York, NY (US)

(72) Inventors: Jun Wang, Fort Washington, PA (US); Viktor Dubovoy, Cresskill, NJ (US); Zeenat Nabi, Cranbury, NJ (US); Jeffrey Mastrull, Flemington, NJ (US); Shujiang Cheng, Warren, NJ (US); Laurence Du-Thumm, Princeton, NJ (US); Long Pan, Somerset, NJ (US)

(73) Assignee: Colgate-Palmolive Company, New York, NY (US)

( * ) Notice: Subject to any disclaimer, the term of this patent is extended or adjusted under 35 U.S.C. 154(b) by 61 days.

(21) Appl. No.: 15/781,199

(22) PCT Filed: Dec. 4, 2015

(86) PCT No.: PCT/US2015/064065

§ 371 (c)(1),
(2) Date: Jun. 4, 2018

(87) PCT Pub. No.: WO2017/095445

PCT Pub. Date: Jun. 8, 2017

(65) Prior Publication Data

US 2018/0355293 A1 Dec. 13, 2018

(51) Int. Cl.

| | |
|---|---|
| ***C11D 1/00*** | (2006.01) |
| ***C11D 9/22*** | (2006.01) |
| ***C11D 3/34*** | (2006.01) |
| ***C11D 3/37*** | (2006.01) |
| ***C11D 9/32*** | (2006.01) |
| ***C11D 3/22*** | (2006.01) |
| ***C11D 17/00*** | (2006.01) |
| ***C11D 10/04*** | (2006.01) |

(52) U.S. Cl.

CPC ..... *C11D 9/225* (2013.01); *C11D 1/008* (2013.01); *C11D 3/222* (2013.01); *C11D 3/349* (2013.01); *C11D 3/37* (2013.01); *C11D 3/3707* (2013.01); *C11D 9/32* (2013.01); *C11D 10/04* (2013.01); *C11D 17/006* (2013.01)

(58) Field of Classification Search

CPC ..... C11D 9/225; C11D 3/349; C11D 3/3707; C11D 9/32; C11D 10/04; C11D 17/006

See application file for complete search history.

(56) References Cited

U.S. PATENT DOCUMENTS

| | | | | |
|---|---|---|---|---|
| 5,786,312 | A * | 7/1998 | Post | C11D 17/006 510/152 |
| 6,344,435 | B1 * | 2/2002 | Miyahara | C07C 309/14 510/494 |
| 6,352,965 | B1 | 3/2002 | Saito et al. | |
| 9,856,441 | B2 | 1/2018 | Gu et al. | |
| 2016/0312161 | A1 * | 10/2016 | Gu | C11D 9/32 |

FOREIGN PATENT DOCUMENTS

| | | |
|---|---|---|
| JP | 2001-200294 A | 7/2001 |
| WO | 2015/088489 | 6/2015 |

OTHER PUBLICATIONS

International Search Report and Written Opinion of the International Searching Authority in International Application No. PCT/US2015/064,065, dated Aug. 8, 2016.

Ishida, 2001, "Solid soap useful as a skin cleaner, contains a polymer, a fatty acid salt, and aminoethyl sulfonic acids," WPI Thomson Database AN: 2001-641706 and JP 2001-200294A.

* cited by examiner

*Primary Examiner* — Necholus Ogden, Jr.

(57) ABSTRACT

Described herein, are cleansing bar compositions comprising at least one cleanser chosen from soap and surfactant; taurine, in free or salt form; and at least one polymer. Methods of making using the cleansing bar compositions are also described.

6 Claims, No Drawings

CLEANSING BARS WITH TAURINE

BACKGROUND

Taurine (2-aminoethanesulfonic acid) is a natural organic acid present in many animal organisms. Taurine is essential to the healthy maintenance of skeletal muscle, cardiovascular function, and central nervous system function. It is also an anti-oxidant and it helps stabilize cellular membranes.

Over the last 15 years, taurine and taurine derivatives have been used in a variety of cosmetic and personal care compositions, including hair conditioners, moisturizers, cleansing products, shaving cream and after-shave compositions. Taurine is suspected to have anti-fibrotic properties and has been shown to protect hair follicles from damage caused by the transforming growth factor family of proteins. Taurine also helps maintain skin hydration, contributing to the healthy maintenance of the skin barrier, and helps reduce inflammation and/or irritation of the skin.

Most of the cosmetic and personal care products that contain taurine are non-solid compositions, such as gels, creams, lotions, and liquids. In attempting to formulate a solid cleansing bar composition containing taurine, the inventors have found that under normal aging conditions (e.g., dry room temperature aging), gritty solid particles or crystals of taurine precipitate out of the composition on its surface. This gives the cleansing bar an unwelcome abrasive feel. Consequently, there is a need for formulating cleansing soap bars that deliver the beneficial effects of taurine without undesirable precipitation of taurine on the surface.

SUMMARY

The inventors have discovered that taurine can be stabilized in a solid cleansing bar composition by the inclusion of a polymer.

In a first exemplary embodiment, the present disclosure provides a cleansing bar composition comprising:

a) at least one cleanser chosen from soap and surfactant;
b) taurine, in free or salt form; and
c) at least one polymer, wherein the composition is a solid cleansing bar.

In a second exemplary embodiment, the invention includes a method of inhibiting taurine crystallization in a cleansing bar comprising a) combining taurine, in free or salt form with a polymer to form a mixture;
b) adding the mixture to at least one cleanser chosen from soap and surfactant; and
c) forming a cleansing bar.

The present disclosure also provides for the use of a polymer to prevent the crystallization of taurine when taurine is incorporated into a bar soap.

DETAILED DESCRIPTION

Unless otherwise specified, all percentages and amounts expressed herein and elsewhere in the specification should be understood to refer to percentages by weight. As used throughout, ranges are used as shorthand for describing each and every value that is within the range. Any value within the range can be selected as the terminus of the range.

As used herein, the term "cleansing bar" shall include bars for cleansing and personal hygienic use comprising a cleanser chosen from soap and surfactant. The cleansing bar may be a soap bar (soap is the cleanser), syndet (non-soap surfactant is the cleanser), or combar (a mixture of soap and surfactant).

The present disclosure provides cleansing bars containing one or more cleansing materials, taurine, and a polymer. In one embodiment, the polymer is a polyethylene oxide-polypropylene oxide block copolymer.

In one exemplary embodiment, the present disclosure provides a cleansing bar composition (Composition 1) comprising:

a) at least one cleanser component chosen from soap and surfactant;
b) taurine, in free or salt form; and
c) at least one polymer.

The present disclosure provides additional exemplary embodiments, including 1.1 Composition 1, wherein the taurine is in free form (i.e., 2-aminoethanesulfonic acid).

1.2 Composition 1, wherein the taurine is in salt form, for example in acid addition salt form (e.g., taurine hydrochloride, taurine sulfate, taurine acetate).

1.3 Composition 1, wherein the taurine is in salt form, for example, in base addition salt form, e.g. as an alkali metal salt, alkaline earth metal salt, or ammonium salt (e.g., sodium, potassium, lithium, calcium or magnesium salt, or ammonium or tetralkylammonium salt, e.g., tetrabutylammonium salt).

1.4 Any of Compositions 1 or 1.1-1.3, where the weight ratio of taurine to polymer is 1:4 to 4:1, e.g., 1:3 to 3:1, or 1:2 to 2:1.

1.5 Any of Compositions 1 or 1.1-1.4, where the weight ratio of taurine to polymer is about 1:1.

1.6 Any of Compositions 1 or 1.1-1.5, wherein the taurine in free or salt form comprises from 0.1% to 10% by weight of the composition, measured as the equivalent amount of taurine in free form, e.g., from 1% to 10%, or e.g., from 2% to 8%, or e.g., from 4% to 6%, or about 5%, or e.g., from 1% to 7%, or e.g., from 3 to 5%, or e.g., about 4%, e.g., about 3.8%.

1.7 Any of Compositions 1 or 1.1-1.6, wherein the taurine in free or salt form comprises from 1% to 10% by weight of the composition, measured as the equivalent amount of taurine in free form.

1.8 Any of Compositions 1 or 1.1-1.7, wherein the taurine in free or salt form comprises from 2% to 8% by weight of the composition, measured as the equivalent amount of taurine in free form.

1.9 Any of Compositions 1 or 1.1-1.8, wherein the taurine in free or salt form comprises from 4% to 6% by weight of the composition, measured as the equivalent amount of taurine in free form.

1.10 Any of Compositions 1 or 1.1-1.9, wherein the taurine in free or salt form comprises about 5%, or about 4%, or about 3.8% by weight of the composition, measured as the equivalent amount of taurine in free form.

1.11 Any of Compositions 1 or 1.1-1.10, wherein the at least one cleanser component comprises a soap, for example, an alkali metal (e.g., sodium or potassium) or alkylammonium (e.g., mono-, di- or tri-ethanol ammonium) salt of a carboxylic acid.

1.12 Any of Compositions 1 or 1.1-1.11, wherein at least one cleanser component comprises an alkali metal (e.g., sodium or potassium) or alkylammonium salt of a fatty acid, e.g., a C8-22 saturated or unsaturated fatty acid, preferably a C10-20 saturated or unsaturated fatty acid.

1.13 Any of Compositions 1 or 1.1-1.12, wherein the at least one cleanser component comprises an alkali metal salt (e.g., sodium or potassium) or alkylammonium salt of a C8-22 carboxylic acid.

1.14 Any of Compositions 1 or 1.1-1.13, wherein the at least one cleanser component comprises the alkali metal (e.g., sodium or potassium) or alkylammonium salts of the fatty acids present in a natural vegetable oil, e.g., palm kernel oil, palm oil, coconut oil, olive oil or laurel oil, or in tallow (rendered animal fat).

1.15 Any of Compositions 1 or 1.1-1.14, wherein the at least one cleanser component comprises the alkali metal salt (e.g., sodium or potassium) of palm oil or coconut oil.

1.16 Any of Compositions 1 or 1.1-1.15, wherein the at least one cleanser component comprises from about 30, 40, 50 or 60% by weight of the composition to about 70, 80, 85, 90 or 95% by weight of the composition.

1.17 Any of the Compositions 1 or 1.1-1.15, wherein the at least one polymer is selected from the group consisting of polyethylene oxide-polypropylene oxide block copolymer, polyoxyalkylene copolymer, polysorbate, polyoxyethylene sorbitan monolaurate, polyethylene, polypropylene, polyethylene glycol, polypropylene glycol, polyacrylic acid, acrylate copolymer, polyurethane, gum, xanthan gum, guar gum, gellan gum, carrageenan, acacia, gelatin, karaya gum, kelp, locust bean gum, pectin, and tragacanth gum.

1.18 The composition of 1.17, wherein the polyethylene oxide-polypropylene oxide block copolymer has a number average molecular weight of the polyoxypropylene block of 1500 to 15000, and the percentage of polyoxyethylene is 10 to 90%.

1.19 Any of Compositions 1.17-1.18, wherein the polyethylene oxide-polypropylene oxide block copolymer has a number average molecular weight of the polyoxypropylene block of 2500 to 4500, and the percentage of polyoxyethylene is 10 to 90%.

1.20 Any of Compositions 1.17-1.19, wherein the polyethylene oxide-polypropylene oxide block copolymer has a number average molecular weight of the polyoxypropylene block of 3000 to 4000, and the percentage of polyoxyethylene is 10 to 80%.

1.21 Any of Compositions 1.17-1.20, wherein the polyethylene oxide-polypropylene oxide block copolymer has a number average molecular weight of the polyoxypropylene block of 3600 to 4000, and the percentage of polyoxyethylene is 60-70%, e.g., wherein the number average molecular weight is about 3600 and the percentage of polyoxyethylene is about 70%.

1.22 Any of Compositions 1 or 1.1-1.21, wherein the at least one polymer, e.g., the polyethylene oxide-polypropylene oxide block copolymer, comprises 0.1% to 10% by weight of the composition, e.g., from 1% to 10%, or e.g., from 2% to 8%, or e.g., from 4% to 6%, or about 5%, or e.g., from 1% to 7%, or e.g., from 3 to 5%, or e.g., about 4%, e.g., about 3.8%.

1.23 Any of Compositions 1 or 1.1-1.22, wherein at least one polymer, e.g., the polyethylene oxide-polypropylene oxide block copolymer, comprises 2% to 8% by weight of the composition.

1.24 Any of Compositions 1 or 1.1-1.23, wherein the at least one polymer, e.g., the polyethylene oxide-polypropylene oxide block copolymer, comprises 4% to 6% by weight of the composition.

1.25 Any of Compositions 1 or 1.1-1.24, wherein the at least one polymer, e.g., the polyethylene oxide-polypropylene oxide block copolymer, comprises about 5%, or about 4% or about 3.8% by weight of the composition.

1.26 Any of Compositions 1 or 1.1-1.25, further comprising an anionic surfactant, cationic surfactant, zwitterionic surfactant, amphoteric surfactant, nonionic surfactant, or a combination thereof.

1.27 Any of Compositions 1 or 1.1-1.26, further comprising inorganic salts, brighteners, perfumes, colorants, sequestering agents, opacifiers, pearlizers, chelating agents (e.g., EDTA), humectants (e.g., polyols, for example, glycerol), or any combination thereof.

1.28 Any of Compositions 1 or 1.1-1.27, wherein the at least one polymer, e.g., the polyethylene oxide-polypropylene oxide block copolymer prevents the precipitation (e.g., crystallization) of taurine on the surface of the cleansing bar.

1.29 Any composition which is the product of the combination of ingredients as identified for Composition 1 or 1.1-1.28.

1.30 Any foregoing composition wherein the taurine and polymer are pre-mixed, e.g., prior to combination with the soap component, such that the surface of the taurine particles is coated by the polymer.

1.31 Any foregoing composition wherein the taurine is substantially coated by the polymer.

1.32 Any foregoing composition wherein taurine does not precipitate or crystallize on the surface of the cleansing bar during aging.

1.33 Any foregoing composition wherein the polymer is not a cationic polymer and/or is not a silicone polymer.

1.34 Any foregoing composition, wherein the composition does not comprise a cationic polymer, or does not comprise a silicone polymer, or does not comprise either.

1.35 Any foregoing composition, wherein the taurine in free or salt form is added to the cleansing bar composition during manufacture as a solid.

The inventors have discovered that taurine can be stabilized in cleansing bars by the addition of a polymer. The polymer prevents the precipitation (e.g., crystallization) of taurine on the surface of the cleansing bar as it ages. Also, the polymer can increase the whiteness of the soap when taurine is included.

Examples of the polymer include, but are not limited to, polyethylene oxide-polypropylene oxide block copolymer, polyoxyalkylene copolymer, polysorbate, polyoxyethylene sorbitan monolaurate, polyethylene, polypropylene, polyethylene glycol, polypropylene glycol, polyacrylic acid, acrylate copolymer, polyurethane, gum, xanthan gum, guar gum, gellan gum, carrageenan, acacia, gelatin, karaya gum, kelp, locust bean gum, pectin, and tragacanth gum. Any combination of such polymers may be included in the composition.

Polyethylene oxide-polypropylene oxide block copolymers are commonly known by the generic term "poloxamer", and have the general formula $(EO)_x(PO)_y(EO)_z$, with x, y and z being selected depending on the number average molecular weight of the PO portion and the percentage of EO in the copolymer. These copolymers are designated by a three digit number: the first two digits×100 give the approximate molecular mass of the polyoxypropylene block, and the last digit×10 gives the EO percentage. In one embodiment, the number average molecular weight of the polyoxypropylene block is 1500 to 15000, and the percentage of polyoxyethylene is 10 to 90%. In another embodiment, the number average molecular weight of the polyoxypropylene block is 2500 to 4500, and the percentage of polyoxyethylene is 10 to 90%. In another embodiment, the number average molecular weight of the polyoxypropylene block is 3000 to 4000, and the percentage of polyoxyethylene is 10 to 80%. In another embodiment, the number average molecular weight of the polyoxypropylene block is 3600 to 4000, and the percentage of polyoxyethylene is 70%.

In one embodiment, the polyethylene oxide-polypropylene oxide block copolymer is poloxamer 407 (which has a polyoxypropylene molecular mass of approximately 4,000 g/mol and a 70% polyoxyethylene content). In one embodiment, the polyethylene oxide-polypropylene oxide block copolymer can be purchased as Pluronic F127 from BASF. In this designation, the copolymers start with a letter that indicates the physical form at room temperature (L=liquid, P=paste, F=flake), which is then followed by two or three digits, The first digit (or two digits in a three-digit number) in the designation is multiplied by 300 to indicate the approximate molecular weight of the PO portion; and the last digit×10 gives the EO percentage. Pluronic F127 thus has a molecular mass of approximately 3600 g/mol and a 70% EO content). In other embodiments, the polyethylene oxide-polypropylene oxide block copolymer is Pluronic F108 (MW of 3000 and 80% EO), Pluronic L101 (MW of 3000, 10% EO), Pluronic P123 (MW of 3600, 30% EO), or Pluronic P104 (MW of 3000, 40% EO).

Suitable acrylate copolymers include, but are not limited to, those described in U.S. Pat. No. 6,635,702 B1, and, in more general terms, those selected from the group consisting of:

a. monomers or copolymers of one or more of methacrylic acid, acrylic acid, itaconic acid, esters of any of the foregoing and mixtures of any of the foregoing; and
b. a member of group (a) copolymerized with one or more members selected from the group consisting of Steareth-20, Steareth-50, Ceteth-20.

Examples of suitable acrylate copolymers include those sold under the tradenames CARBOPOL® AQUA SF-1 from Noveon (Cleveland, Ohio), SYNTHALEN® W2000 from 3V (Wehawkin, N.J.), ACULYN® 22, and ACULYN® 33 available from International Specialty Products Corporation (Wayne, N.J.).

In preparing the cleansing bars of the present disclosure, the taurine component can be pre-mixed with the polymer, e.g., encapsulated by the polymer, prior to blending with the other components of the cleansing bar composition. Alternatively, the taurine can blended into the other components of the cleansing bar composition, before or after the addition of the polymer. Preferably, the taurine and polymer are pre-mixed and processed to ensure coating of the surface area of the taurine particles by the polymer.

The cleansing bar of the present disclosure includes at least one cleanser component. In certain embodiments the cleanser component is a hydrophilic soap chip (e.g., "a base component"). The term "soap" or "soap chip" is used herein in its popular sense, i.e., the alkali metal or alkanol ammonium salts of aliphatic alkane or alkene monocarboxylic acids. Sodium, potassium, mono-, di- and tri-ethanol ammonium cations, or combinations thereof, are suitable for purposes of this invention. In general, sodium soaps are used in the compositions of the present disclosure, but from about 1% to about 25% of the soap may be ammonium, potassium, magnesium, calcium soaps or a mixture of these soaps.

The soap chips useful herein include, but are not limited to, the well-known alkali metal salts of aliphatic (alkanoic or alkenoic) acids having about 8 to 22 carbon atoms, preferably 10 to 20 carbon atoms. These may be described as alkali metal carboxylates of alkanoic or alkenoic hydrocarbons having about 12 to about 22 carbon atoms. Soaps having the fatty acid distribution of common vegetable oils may be suitable, e.g., palm kernel oil, palm oil, coconut oil, olive oil or laurel oil, or the fatty acid distribution of tallow (rendered animal fat). The soap may comprise the fatty acid distribution of any combination of natural or synthetic fatty acid sources (e.g., any combination of natural animal or vegetable fats or oils, and/or individual fatty acids).

Any other surfactant can also be present in the soap chip which include but are not limited to sulfate, sulfonate alpha olefin sulfonates, isethionates such as SCI, N-alkyl or N-acyl taurates, sulfosuccinate, phosphates, glycinates, amphoteric surfactants such as betaines, sulfobetaines and the like and nonionic surfactants such as alkanolamide, alkylpolyglycosides.

In one exemplary embodiment, the cleansing bar of this disclosure includes at least 70% by weight of cleanser active compounds (e.g., soap active compounds).

In an alternate exemplary embodiment, the cleanser of the composition consists essentially of anionic surfactant, nonionic surfactants, amphoteric surfactants, cationic surfactants and mixtures thereof.

Optional ingredients can be present in the cleansing bar composition. Non-limiting examples include skin conditioning agents, moisturizing agents, fragrance, dyes and pigments, titanium dioxide, chelating agents such as EDTA, sunscreen active ingredients such as butyl methoxy benzoylmethane; antiaging compounds such as alpha hydroxy acids, beta hydroxy acids; antimicrobial materials such as triclocarban, triclosan and the like; preservatives such as hydantoins, imidazolines; polyols such as glycerol, sorbitol, propylene glycol and polyethylene glycols; particulate matter such as silica, talc, or calcium carbonate; antioxidants such as butylated hydroxytoluene (BHT); vitamins such as A, E, K and C; essential oils and extracts thereof such as rosewood and jojoba, particulate matter such as polyethylene beads, jojoba beads, lufa, or oat flour, and mixtures of any of the foregoing components.

In one embodiment the cleansing bar includes fragrance in an amount of 0.001% to 2% by weight of the composition.

In one embodiment the cleansing bar includes pearlizers, such as titanium dioxide, in an amount of 0.01% to 1% by weight.

In one embodiment the cleansing bar includes one or more pigments, such as chromium oxide green, in an amount of 0.001% to 1% by weight.

In one embodiment, the cleansing bar includes silica, or silicon dioxide, incorporated at a level of from about 0.1% to about 15%, preferable from about 1% to about 10%, more preferably from about 3% to about 7%. Silica is available in a variety of forms, including but not limited to, crystalline, amorphous, fumed, precipitated, gel, and colloidal forms.

In one embodiment, the cleansing bar includes free fatty acids to provide enhanced skin feel benefits, such as softer or smoother feeling skin. Suitable free fatty acids include those derived from tallow, coconut oil, palm oil and palm kernel oil.

In a second exemplary embodiment, the invention includes a method (Method 1) of inhibiting taurine precipitation (e.g., crystallization) on the surface of a cleansing bar, comprising a) combining taurine, in free or salt form, with a polymer to form a mixture;
b) adding the mixture to at least one cleanser chosen from soap and surfactant; and
c) forming a cleansing bar.

The present disclosure provides additional exemplary embodiments, including 1.1 Method 1, wherein the taurine is in free form (i.e., 2-aminoethanesulfonic acid).

1.2 Method 1, wherein the taurine is in salt form, for example in acid addition salt form (e.g., taurine hydrochloride, taurine sulfate, taurine acetate).

1.3 Method 1, wherein the taurine is in salt form, for example as an alkali metal salt, alkaline earth metal salt, or ammonium salt (e.g., sodium, potassium, lithium, calcium or magnesium salt, or ammonium or tetralkylammonium salt, e.g., tetrabutylammonium salt).

1.4 Any of Methods 1 or 1.1-1.3, wherein the weight ratio of taurine to polymer is 1:4 to 4:1, e.g., 1:3 to 3:1, or 1:2 to 2:1.

1.5 Any of Methods 1 or 1.1-1.4, wherein the weight ratio of taurine to polymer is about 1:1.

1.6 Any of Method 1 or 1.1-1.5, wherein the taurine in free or salt form comprises from about 0.1% to about 10% by weight of the cleansing bar, measured as the equivalent amount of taurine in free form, e.g., from about 1% to about 10%, or e.g., from about 2% to about 8%, or e.g., from about 4% to about 6%, or about 5%, or e.g., from 1% to 7%, or e.g., from 3 to 5%, or e.g., about 4%, e.g., about 3.8%.

1.7 Any of Method 1 or 1.1-1.6, wherein the taurine in free or salt form comprises from 1% to 10% by weight of the composition, measured as the equivalent amount of taurine in free form.

1.8 Any of Method 1 or 1.1-1.7, wherein the taurine in free or salt form comprises from 2% to 8% by weight of the composition, measured as the equivalent amount of taurine in free form.

1.9 Any of Method 1 or 1.1-1.8, wherein the taurine in free or salt form comprises from 4% to 6% by weight of the composition, measured as the equivalent amount of taurine in free form.

1.10 Any of Method 1 or 1.1-1.9, wherein the taurine in free or salt form comprises about 5% or about 4%, or about 3.8%, by weight of the composition, measured as the equivalent amount of taurine in free form.

1.11 Any of Methods 1 or 1.1-1.10, wherein the at least one cleanser component comprises a soap, for example, an alkali metal (e.g., sodium or potassium) or alkylammonium (e.g., mono-, di- or tri-ethanol ammonium) salt of a carboxylic acid.

1.12 Any of Methods 1 or 1.1-1.11, wherein the at least one cleanser component comprises an alkali metal (e.g., sodium or potassium) or alkylammonium salt of a fatty acid, e.g., a C8-22 saturated or unsaturated fatty acid, preferably a C10-20 saturated or unsaturated fatty acid.

1.13 Any of Methods 1 or 1.1-1.12, wherein the at least one cleanser component comprises an alkali metal salt (e.g., sodium or potassium) or alkylammonium salt of a C8-22 carboxylic acid.

1.14 Any of Methods 1 or 1.1-1.13, wherein the at least one cleanser component comprises the alkali metal (e.g., sodium or potassium) or alkylammonium salts of the fatty acids present in a natural vegetable oil, e.g., palm kernel oil, palm oil, coconut oil, olive oil or laurel oil, or in tallow (rendered animal fat).

1.15 Any of Methods 1 or 1.1-1.14, wherein the at least one cleanser component comprises the alkali metal salt (e.g., sodium or potassium) of palm oil or coconut oil.

1.16 Any of Methods 1 or 1.1-1.15, wherein the at least one cleanser component comprises from about 30, 40, 50 or 60% by weight of the composition to about 70, 80, 85, 90 or 95% by weight of the composition.

1.17 Any of Methods 1 or 1.1-1.16, wherein the at least one polymer is selected from the group consisting of polyethylene oxide-polypropylene oxide block copolymer, polyoxyalkylene copolymer, polysorbate, polyoxyethylene sorbitan monolaurate, polyethylene, polypropylene, polyethylene glycol, polypropylene glycol, polyacrylic acid, acrylate copolymer, polyurethane, gum, xanthan gum, guar gum, gellan gum, carrageenan, acacia, gelatin, karaya gum, kelp, locust bean gum, pectin, and tragacanth gum.

1.18 The Method of 1.17, wherein the polyethylene oxide-polypropylene oxide block copolymer has a number average molecular weight of the polyoxypropylene block of 1500 to 15000, and the percentage of polyoxyethylene is 10 to 90%.

1.19 Any of Methods 1.17-1.18, wherein the polyethylene oxide-polypropylene oxide block copolymer has a number average molecular weight of the polyoxypropylene block of 2500 to 4500, and the percentage of polyoxyethylene is 10 to 90%.

1.20 Any of Methods 1.17-1.19, wherein the polyethylene oxide-polypropylene oxide block copolymer has a number average molecular weight of the polyoxypropylene block of 3000 to 4000, and the percentage of polyoxyethylene is 10 to 80%.

1.21 Any of Methods 1.17-1.20, wherein the polyethylene oxide-polypropylene oxide block copolymer has a number average molecular weight of the polyoxypropylene block of 3600 to 4000, and the percentage of polyoxyethylene is 70%.

1.22 Any of Methods 1 or 1.1-1.21, wherein the at least one polymer, e.g., the polyethylene oxide-polypropylene oxide block copolymer, comprises about 0.1% to about 10% by weight of the cleansing bar, e.g., from about 1% to about 10%, or e.g., from about 2% to about 8%, or e.g., from about 4% to about 6%, or about 5%, or e.g., from 1% to 7%, or e.g., from 3 to 5%, or e.g., about 4%, e.g., about 3.8%.

1.23 Any of Methods 1 or 1.1-1.22, wherein at least one polymer, e.g., the polyethylene oxide-polypropylene oxide block copolymer, comprises 2% to 8% by weight of the composition.

1.24 Any of Methods 1 or 1.1-1.23, wherein at least one polymer, e.g., the polyethylene oxide-polypropylene oxide block copolymer, comprises 4% to 6% by weight of the composition.

1.25 Any of Methods 1 or 1.1-1.24, wherein at least one polymer, e.g., the polyethylene oxide-polypropylene oxide block copolymer, comprises about 5%, or about 4% or about 3.8%, by weight of the composition.

1.26 Any of Methods 1 or 1.1-1.25, wherein the taurine and the polymer are pre-mixed together, e.g., wherein the taurine is in powder form and combined with the polymer prior to being combined with any aqueous or hydrophilic soap components.

1.27 Any of Methods 1 or 1.1-1.26, wherein the polymer is heated to or above its melting point before it is combined with the taurine.

1.28 Any of Methods 1 or 1.1-1.27, wherein the taurine is substantially coated by the polymer.

1.29 Any of Methods 1 or 1.1-1.28, wherein the pre-mixture of taurine with the polymer is then blended with soap chips, and any other optional components of the final cleansing bar composition.

1.30 Any of Methods 1 or 1.1-1.29, further comprising the step of adding additional optional ingredients to the blended taurine/polymer and soap mixture.

1.31 Any of Methods 1 or 1.1-1.30, further comprising the processing of the final composition to produce cleansing bars.

1.32 Any of Methods 1 or 1.1-1.31, wherein the polymer is not a cationic polymer and/or is not a silicone polymer.

1.33 Any of Methods 1 or 1.1-1.31, wherein the method does not comprise the addition of a cationic polymer, or does not comprise the addition of a silicone polymer, or does not comprise the addition of either.

1.34 Any if Methods 1 or 1.1-1.33, wherein the taurine in free or salt form is added as a solid.

1.35 Any of Methods 1 or 1.1-1.34, wherein the product cleansing bars consist essentially of any one of Compositions 1 or 1.1-1.35.

1.36 A cleansing bar that is prepared according to any of Methods 1 or 1.1-1.35.

The cleansing bars of the present disclosure may be prepared by any of the techniques known to those skilled in the art, including both batch processes and continuous processes. The first step in the preparation of the cleansing bar is the preparation of the soap component. Techniques known to those skilled in the art may be used, such as the classic kettle boiling process or the modern continuous soap manufacturing process. For example, an appropriate fat, oil, or carboxylic acid, or mixture thereof, is first combined with a base (e.g., sodium or potassium hydroxide or carbonate) in the presence of water to form the soap component. The soap component can then be processed and purified to remove excess base and/or glycerol as needed, and formed into chips, pellets, noodles or other solid or semi-solid forms. Optional ingredients such as additional surfactants may also be added after the removal of excess base but before formation into chips, pellets or noodles. The soap component may then be ground up, suspended in water and combined with the taurine and polymer, as well as other optional additives. Preferably, the taurine and polymer are pre-mixed, with melting of the polymer, e.g., the polyethylene oxide-polypropylene oxide block copolymer, if necessary. The mixture is processed, as by stirring or grinding to promote an even coating of the taurine particles by the polymer. The resulting mixture is then blended, with heating if necessary, with the soap chips and any other desired ingredients. After blending, the final composition is then formed into the finished cleansing bar product.

The cleansing bar may be formed by the extrusion method, and may be of varying sizes and shapes such as ovoid or rectangular in shape with either a flat or curved profile as an overall appearance.

Exemplary embodiments of the present disclosure will be illustrated by reference to the following examples, which are included to exemplify, but not to limit the scope of the present invention.

EXAMPLES

Example 1

Analysis of Stabilization Effect 2.50 grams of taurine crystals are placed into a mortar and ground up with a pestle. 2.50 g of polyethylene oxide-polypropylene oxide block copolymer is added. The mixture is thoroughly mixed and ground. Separately, a soap slurry is prepared by grinding up super-fat soap chips to a fine powder and mixing with water in a 1:0.3 ratio by weight. 60 g of this soap slurry is added to taurine/polyethylene oxide-polypropylene oxide block copolymer mixture and mixed to homogeneity. A control is also prepared without the copolymer in which water is added in its place. A small portion of the inventive and control are transferred to syringes and squeezed out to form a "noodle" on a microscope slide.

The noodles on the microscope slides are aged for two weeks at room temperature before being viewed with an Olympus SZX10 stereo microscope and photomicrographs of the noodles of the compositions are analyzed. During aging, most of the water in the soap composition evaporates, so that the final compositions are about 5 wt % taurine and about 5 wt % polymer. The control composition, containing water in place of a polyethylene oxide-polypropylene oxide block copolymer, has clear crystals on the surface of the noodles. In contrast, the composition containing polyethylene oxide-polypropylene oxide block copolymer has substantially reduced levels of crystallization.

Example 2

Color Measurement

The preparation as in Example 1 is repeated. The soap noodles are aged in a 50° C. oven for 7 days and color variance is quantified using a SpectroShade spectrophotometer to measure L, a, and b values, and W is calculated as $W=(a^2+b^2+(L-100)^2)^{1/2}$ as compared to unaged soap chips. The results are described in Table 1 below. A lower ΔW indicates less discoloration compared to the unaged control.

TABLE 1

| Composition | W | ΔW |
|---|---|---|
| Unaged Soap Chips | 10.8 | — |
| Example I (taurine w/polymer) | 23.5 | 12.7 |
| Comparative Example (taurine w/o polymer) | 28.8 | 18.0 |

As illustrated by the data described in Table 1 (above), the addition of an exemplary polymer of the present invention, polyethylene oxide-polypropylene oxide block co-polymer, unexpectedly reduces discoloration in aged soap bars containing taurine.

While particular embodiments of the present invention have been illustrated and described, it will be obvious to those skilled in the art that various changes and modifications may be made without departing from the spirit and scope of the invention. It is therefore intended to cover in the appended claims all such changes and modifications which are within the scope of the invention.

What is claimed is:

1. A cleansing bar composition comprising:

a) at least one cleanser chosen from soap and surfactant;

b) taurine particles, in free form 2-aminoethanesulfonic acid or in salt form thereof including taurine hydrochloride, taurine sulfate, taurine acetate, alkali metal salt of taurine, alkaline earth metal salt of taurine, or ammonium salt of taurine; and c) at least one polymer selected from the group consisting of polyethylene oxide-polypropylene oxide block copolymer, polyoxyalkylene copolymer, polysorbate, polyoxyethylene sorbitan monolaurate, polyethylene, polypropylene, polyethylene glycol, polypropylene glycol, polyacrylic acid, acrylate copolymer, polyurethane, gum, xanthan gum, guar gum, gellan gum, carrageenan, acacia, gelatin, karaya gum, kelp, locust bean gum, pectin, and tragacanth gum;

wherein the taurine particles and the polymer are premixed and processed to coat surface area of the taurine particles with the polymer, and wherein the composition is a solid cleansing bar.

2. The composition of claim 1, wherein the weight ratio of taurine to polymer is from about 1:4 to about 4:1.

3. The composition of claim 1, wherein the taurine particles are present in an amount of 0.1% to 10% by weight of the composition.

4. The composition of claim 1, wherein the at least one polymer comprises 0.1% to 10% by weight of the composition.

5. The composition of claim 1, wherein the at least one polymer prevents crystallization of taurine on the surface of the cleansing bar.

6. The composition of claim 1, wherein the at least one cleanser comprises a soap.

* * * * *